US007155849B2

(12) United States Patent
Hinterkeuser

(10) Patent No.: US 7,155,849 B2
(45) Date of Patent: Jan. 2, 2007

(54) METHOD FOR REPRESENTING AND IMAGE ON A STEPPED SURFACE AND STAIRCASE

(76) Inventor: Josef Hinterkeuser, An der alten Post 24, 59859 Koeln (DE)

( * ) Notice: Subject to any disclaimer, the term of this patent is extended or adjusted under 35 U.S.C. 154(b) by 0 days.

(21) Appl. No.: 10/467,786

(22) PCT Filed: Feb. 12, 2002

(86) PCT No.: PCT/DE02/00497

§ 371 (c)(1),
(2), (4) Date: Jan. 26, 2004

(87) PCT Pub. No.: WO02/065438

PCT Pub. Date: Aug. 22, 2002

(65) Prior Publication Data

US 2004/0134107 A1 Jul. 15, 2004

(30) Foreign Application Priority Data

Feb. 12, 2002 (DE) ..... 101 06 658

(51) Int. Cl.
*G09F 17/00* (2006.01)

(52) U.S. Cl. ..... 40/560; 40/584

(58) Field of Classification Search ..... 40/584, 40/594, 550
See application file for complete search history.

(56) References Cited

U.S. PATENT DOCUMENTS 5,411,127 A * 5/1995 Findlay ..... 198/333
6,041,533 A * 3/2000 Lemmond, Jr. ..... 40/584

* cited by examiner

*Primary Examiner*—Cassandra Davis
(74) *Attorney, Agent, or Firm*—Scott R. Hansen; Fulwider Patton LLP

(57) ABSTRACT

To represent an image on a stepped surface, an eyepoint on the axis of sight in front of partial surfaces of the stepped surface is selected. The image is divided into partial images that are assigned to the partial surfaces. Each partial image is projected from the eyepoint onto the partial surface to which it has been assigned. Alternatively, the image is divided into partial images that are assigned to the partial surfaces so that the first partial image, which is assigned to the first partial surface closest to the eyepoint, is modified by a specified factor. Each additional partial image is enlarged relative to the first partial image based on the distance from the eyepoint of the partial surface to which it is assigned and is then represented on its respective partial surface.

25 Claims, 5 Drawing Sheets

METHOD FOR REPRESENTING AND IMAGE ON A STEPPED SURFACE AND STAIRCASE

RELATED APPLICATIONS

This application claims the benefit of PCT International Application Serial No. PCT/DE02/00497, filed Feb. 12, 2002 which claims the benefit of German Utility Model Application Serial No. DE 101 06 658.9 filed Feb. 12, 2001.

BACKGROUND OF THE INVENTION

1. Field of the Invention

This invention relates to a method for representing an image on a stepped surface with at least two partial surfaces that run at a right angle to an axis of sight and are offset in relation to each other along the axis of sight, as well as a staircase on which an image is represented.

2. Description of Related Art

A method of this type and a staircase of this type are known, for example, from their use in department stores and sports stadiums. On these staircases of the prior art, the image represented on a riser, in a department store for example, can consist of lettering with the name of the department store or directions such as "To the Children's Department", or in a sports stadium can indicate the number of the row or the number of a seat. In these methods of the prior art, the partial surfaces correspond to the risers of the staircase and the axis of sight runs essentially horizontally through the eyes of a person standing in front of the staircase that leads upward.

One disadvantage of this method and staircase of the prior art is that the maximum size of the image is defined by the size and shape of an individual riser, which means that the height of the image is limited to the height of the stair riser, which is generally approximately 18 cm.

SUMMARY OF THE INVENTION

The object of the invention is therefore to create a method and a staircase of the type described above that make it possible to represent larger images.

The invention teaches that this object can be accomplished by a method, the first variant of which consists of the following steps: an eyepoint is selected that lies on the axis of sight in front of the partial surfaces; the image is divided into partial images that are assigned to the partial surfaces, and is projected from the eyepoint onto the partial surfaces; and each partial image is represented on the partial surface to which it has been assigned.

This object is achieved by a second variant of the method that consists of the following steps: an eyepoint is selected that lies on the axis of sight in front of the partial surfaces; the image is divided into partial images that are assigned to the partial surfaces so that the first partial image, which is assigned to the first partial surface that is closest to the eyepoint, is modified in accordance with a specified factor, and that each additional partial image is enlarged relative to the first partial image as a function of the distance from the eyepoint of the partial surface to which it is assigned; and each partial image is represented on the partial surface to which it is assigned.

Both variants described above are based on the teachings presented below, and are explained using the example of a staircase, the riser surfaces of which are used for the representation, although the teachings are also valid for the representation of images on other stepped surfaces.

In contrast to the methods of the prior art, in which the image is represented on only one riser surface of the staircase and therefore can be only as tall as said riser, in these two variants the riser surfaces available for the representation all together form a total surface, the height of which equals the sum of the heights of the individual riser surfaces. The image can therefore be represented on a larger factor than using the methods of the prior art.

In both variants, there is a compensation for the resulting perspective distortion, or more properly the reduction in size, as perceived by the eye of an observer, if the observer looks at the risers from the eyepoint, because the risers are offset relative to one another along the axis of sight and are thus at different distances from the eyepoint. For example, the riser surface of the lowest, first step is closer to the eyepoint by the depth of the tread, which is generally approximately 27 cm, than the riser surface of the second step, which in turn is closer to the eyepoint by the depth of the tread than the riser surface of the third step, etc.

The eyepoint is the starting point for the representation of the image on the stepped surface or on the partial surfaces and it thus defines the position from which an observer perceives the image with only minimal perspective distortions. The eyepoint is selected according to the immediate circumstances and, for the risers of a staircase in a department store, for example, can be at the eye level of an average customer, i.e. at a height of approximately 1.70 meters, and at a horizontal distance of approximately 3 meters from the riser surface at that level.

In the first variant, the image is divided among the partial surfaces by means of a central projection. In the second variant, the image is divided among the partial surfaces by means of enlargement factors that are determined on the basis of the geometric conditions in the individual case, in particular the different distances of the partial surfaces from the eyepoint.

In the second variant, the enlargement factor of a partial image relative to the first partial image can be equal to the quotient of the distance of its corresponding partial surface from the eyepoint and the distance of the first partial surface from the eyepoint.

In both variants, the surface can be formed by the surface of a staircase. In this case, the staircase is an escalator, or the staircase can also be located in a grandstand of a sports stadium or a performance or exhibition venue. In that case, the partial surfaces can also be formed by the risers of the steps, or the partial surfaces can be formed by the tread surfaces of the steps.

The invention teaches that the eyepoint can also be defined by the position of a camera.

The partial images are preferably generated by dividing the image by means of a computer.

The invention teaches that the above mentioned additional object can be achieved on a staircase by a first variant in which the image is divided into partial images which are assigned to the riser surfaces and are represented on the riser surfaces to which they have been assigned; and each partial image is enlarged relative to the lowest partial image corresponding to the horizontal distance of the riser surface to which it is assigned from the lowest riser surface.

The invention teaches that this additional object can be achieved on a staircase by a second variant in which the image is divided into partial images which are assigned to the tread surfaces and are represented on the tread surfaces to which they have been assigned; and each partial image is enlarged relative to the topmost partial image corresponding to the vertical distance of the tread surface to which it has been assigned from the topmost tread surface.

These two variants are based on the same teachings as explained above in connection with the two variants of the method.

The first variant relates to the utilization of the riser surfaces of a staircase. This surface can lie in the field of view of an observer who, for example, has just begun to walk up the staircase, or of a television camera which can be installed in the ceiling of a performance or exhibition venue, for example.

The second variant relates to the utilization of the tread surfaces of a staircase. This surface can lie in the field of view of an observer who, for example, is just about to walk down the staircase, or of a television camera which can be installed, for example, on a grandstand of a sports stadium and which faces the opposite grandstand.

In the first variant, the enlargement factor of a partial image can be equal to the quotient of the sum of the horizontal distance of the riser surface to which it is assigned from the lowest riser surface and the horizontal distance of the lowest riser surface from a specified eyepoint lying in front of the staircase and the horizontal distance of the lowest riser surface from the eyepoint.

In the second variant, the enlargement factor of a partial image can be equal to the quotient of the sum of the vertical distance of the tread surface to which it corresponds from the topmost tread surface and the vertical distance of the topmost tread surface from a specified eyepoint lying above the staircase and the vertical distance of the topmost tread surface from the eyepoint.

In both variants, the staircase can be an escalator, or the staircase is located in a grandstand of a sports stadium or in a performance or exhibition venue.

The eyepoint can also be defined by the position of a camera.

The invention makes it possible above all to utilize staircases for the representation of large-format advertising images.

In both variants of the method, the stepped surface can also have at least one rear partial surface which is offset behind a front partial surface, with respect to the location of an eyepoint, such that a portion of the rear partial surface is concealed by the front partial surface, and this concealed area of the rear partial surface is not used for the representation of the partial image assigned to the rear partial surface. Consequently, only the area of the rear riser surface visible from the eyepoint is used for the representation.

In this case, the invention teaches that: the surface can be formed by the surface of a staircase; the axis of sight runs horizontally; the partial surfaces are formed by riser surfaces of the stairs, at least one riser surface of which, from the point of view of the eyepoint, lies behind that riser surface on which the axis of sight alights, and thus has on its lower edge a strip-shaped area which is concealed by the next-forward riser surface; and the height F1 of the concealed area, measured from the lower edge of the rear riser surface, is determined by the following formula:

$$F_i = t \times G_{i-1} / W_{i-1}$$

where:

i is the index for the stair and i=1 stands for the first, lowest stair, t is the depth of the tread surface of the staircase, $G_{i-1}$ is the vertical distance between the upper edge of the next-forward riser surface and the axis of sight, and $W_{i-1}$ is the horizontal distance between the upper edge of the next forward riser surface and the eyepoint.

In this case, the invention also teaches that the vertical distance $G_{i-1}$ is determined by the following formula:

$$G_{i-1} = (i-1) \times h - H$$

where:

h is the height of the riser surfaces of the staircase, and

H is the vertical distance between the axis of sight and the bottom landing; and the horizontal distance $W_{i-1}$ is determined by the following formula:

$$W_{i-1} = (i-2) \times t + X_A$$

where:

$X_A$ is the horizontal distance between the upper edge of the riser surface of the first step and the eyepoint.

In both variants of the staircase, the invention teaches that the staircase can have at least one rear partial surface which, from the point of view of the eyepoint, is offset behind a front partial surface so that a portion of the rear partial surface is concealed by the front partial surface, and that this concealed area of the rear partial surface is not used for the representation of the partial image assigned to the rear partial surface.

In that case, the invention teaches a first staircase variant in which: the axis of sight can run horizontally; of the riser surfaces, at least one riser surface, from the point of view of the eyepoint, lies behind that riser surface on which the axis of sight alights, and thus on its lower edge has a strip-shaped area that is concealed by the next-forward riser surface; and the height $F_i$ of the concealed region, measured from the bottom edge of the rear riser surface, is determined by the following formula:

$$F_i = t \times G_{i-1} / W_{i-1}$$

where:

i is the index for the step and i=1 is the index for the first, lowest step, t is the depth of the tread surface of the staircase, $G_{i-1}$ is the vertical distance between the upper edge of the next-forward riser surface and the axis of sight, and $W_{i-1}$ is the horizontal distance between the upper edge of the next-forward riser surface and the eyepoint.

In this case, the invention further teaches that the vertical distance $G_{i-1}$ can be determined by the following formula:

$$G_{i-1} = (i-1) \times h - H$$

where:

h is the height of the riser surfaces of the staircase, and

H is the vertical distance between the axis of sight and the bottom landing, and the horizontal distance $W_{i-1}$ can be determined by the following formula:

$$W_{i-1} = (i-2) \times t + X_A$$

where:

$X_A$ is the horizontal distance between the upper edge of the riser surface of the first step and the eyepoint.

Additional features and configurations of the invention are disclosed in the subclaims.

The invention is described in greater detail below with reference to the exemplary embodiments illustrated in the accompanying drawings.

DETAILED DESCRIPTION OF THE PREFERRED EMBODIMENTS

Figure 1:
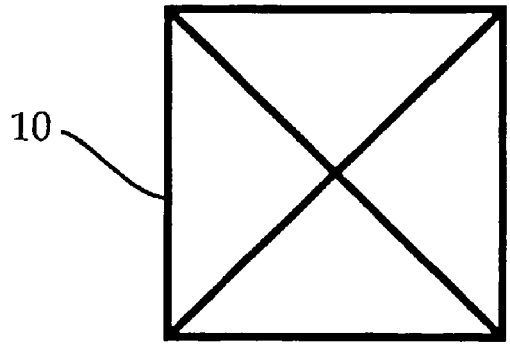
FIG. 1 shows an image in its original condition which is to be represented on the steps of a staircase.

FIG. 1 shows an image 10, which in this case is a simple square with its two diagonals, shown in its original condition, which is to be represented on the riser surfaces 11 of three adjacent steps 12, 13, 14 of a conventional staircase. Riser surfaces 11 are illustrated individually in the drawings as surfaces 11.9, 11.10 and 11.11.

Figure 2:
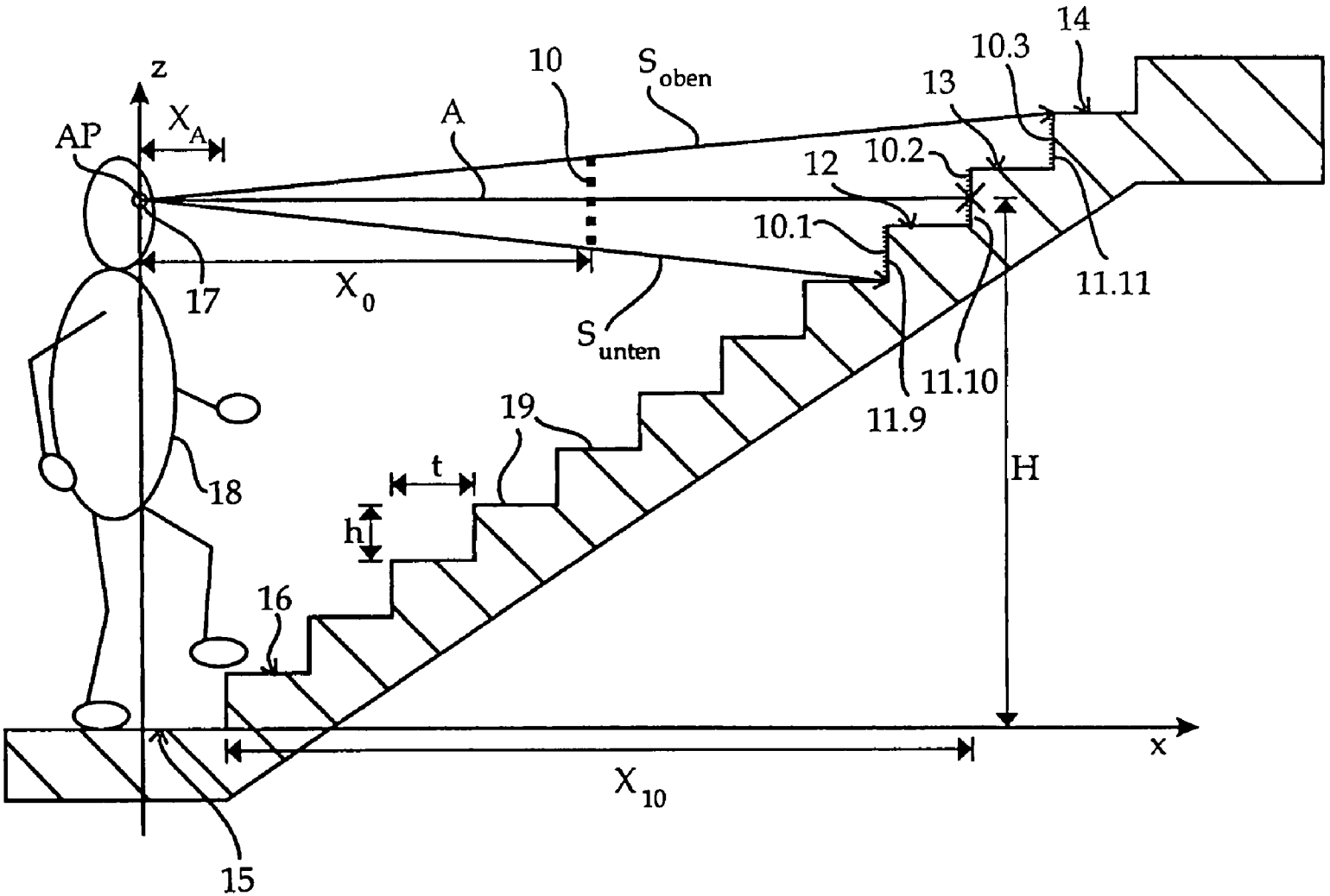
FIG. 2 is a side view of a staircase, on the steps of which the image illustrated in FIG. 1 is represented.

FIG. 2 shows this staircase, and for purposes of discussion it will be assumed that the step height h=18 cm and the step depth t=27 cm. The three steps 12–14 comprise the ninth, tenth and eleventh steps of the staircase, counting from the bottom landing 15, so that the middle of the riser surface 11.10 of the tenth step 13, which corresponds to the middle of the total surface formed by the corresponding three riser surfaces 11.9, 11.10, 11.11, is at a height of H=1.71 m (=10×0.18 m−0.5×0.18 m) above the lower landing 15. The horizontal distance of this tenth riser surface 11.10 from the bottom landing 15, i.e. of the riser surface 11.1 from the first, lowest step 16, is therefore $X_{10}$=2.43 m (=9×0.27 m).

The choice of the three steps 12–14 was in this case made with regard to the above mentioned height H, because this height H is frequently where the eyes 17 of a large number of people 18 will be when they are standing on the bottom landing 15 and are just about to ascend the staircase. For the eyepoint AP, which is required for the division of the image 10 (indicated in FIG. 2 by a thick dotted line) into the three partial images 10.1, 10.2, 10.3 (indicated in FIG. 2 by thin dotted lines), this height H has also been selected as the z-coordinate. For the selection of the x-coordinate of the eyepoint AP, in this case the observer 18 illustrated in FIG. 2 is used as a reference, standing on the bottom landing 15 a short distance in front of the first step 16, so that the horizontal distance $X_A$ of his eyes 17 from the first riser surface 11.1 is approximately 15 cm. The sum of this horizontal distance $X_A$ and the previously calculated horizontal distance $X_{10}$ of the tenth riser surface 11.10 from the first riser surface 11.1 is 2.58 m (=0.15 m+2.43 m), and this sum is also used below as the x-coordinate for the eyepoint AP.

At this point, it should be noted that the selection of the eyepoint AP is intended to be used only as an example, and the position of the eyepoint can be varied as necessary.

In a first realization of a method for the representation of the image 10 on the three riser surfaces 11.9–11.11, the image 10, as shown in FIG. 2, is oriented at a right angle to the axis of sight A, which in this case corresponds to the horizontal connecting line between the eyepoint AP and the middle M of the tenth riser surface 11.10, so that all the lines of sight $S_{bottom}$ beginning at the eyepoint AP that alight on the bottom edge of the ninth riser surface 11.9 intersect the bottom edge of the image 10 and the lines of sight $S_{top}$ that alight on the upper edge of the eleventh riser surface 11.11 intersect the upper edge of the image 10. As a result of this arrangement, the total surface made available by the three riser surfaces 11.9–11.11 for the representation of the image can be optimally utilized, as will be explained in further detail below.

Now the individual pixels can be projected onto the stepped total surface, starting from the eyepoint AP, whereby the image 10 is divided into three partial images 10.1, 10.2, 10.3. The first partial image 10.1 is formed by those lines of sight that intersect both the image 10 and the ninth riser surface 11.9, the second partial image 10.2 is formed by those lines of sight that intersect both the image 10 and the tenth riser surface 11.10, and the third partial image 10.3 is formed by those lines of sight that intersect both the image 10 and the eleventh riser surface 11.11.

Figure 3:
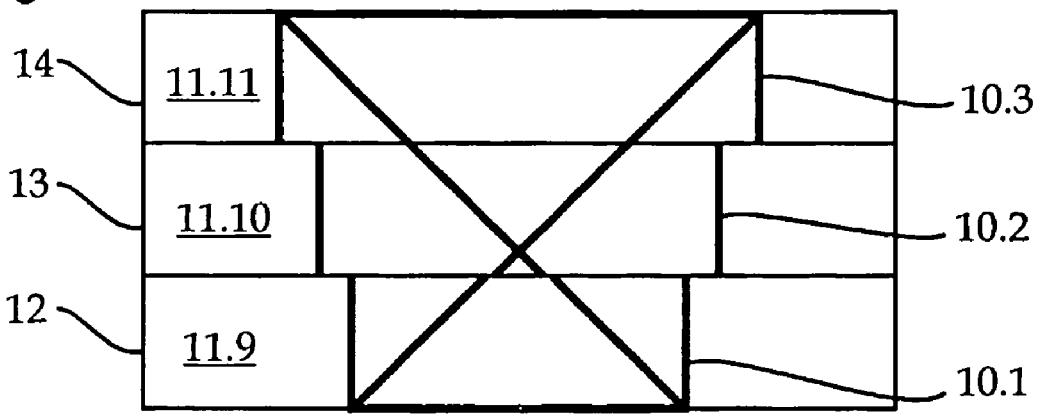
FIG. 3 shows the partial images that are arranged one above the other in a plane.

In FIG. 3 (which is not drawn to the same scale as FIG. 2), these three partial images 10.1–10.3 are oriented in a plane, lying one on top of another, to facilitate comparison, so that they can be properly compared with the original image 10 shown in FIG. 1. FIG. 3 shows that all three partial images 10.1–10.3 have the same height, which is specified by the height h of the three riser surfaces 11.9–11.11, although they have different widths. This difference results from the different horizontal distances of the three riser surfaces from the eyepoint AP (also called the "eye point distances" below), so that in the projection of the beamset described above, the enlargement factor with which the image 10 is projected onto a riser surface 11 equals the quotient from the eye point distance of this riser surface 11 and the eye point distance $X_0$ of the image 10. It therefore follows that the relative factor of a partial image to the first partial image, i.e. to the partial image 10.1 projected onto the ninth riser surface, equals the quotient of the eye point distance of this partial image and the eyepoint distance of the first partial image 10.1. With the values assumed above, therefore, the factor of the second partial image 10.2 is greater by the factor 1.12 (=2.58/2.31=[0.15 m+9×0.27 m]/[0.15 m+8.0.27 m] than that of the first partial image 10.1 and the scale of the third partial image 10.3 is greater by a factor of 1.23 (=2.85/2.31=[0.15 m+10×0.27 m]/[0.15 m+8×0.27 m] than that of the first partial image 10.1.

As a result of this enlargement, which increases with the distance from the eyepoint, there is compensation for the perspective size reduction that results for the eye 17 of the observer 18 when he looks at the staircase with the partial images 10.1–10.3. This compensation is clearly illustrated in FIG. 4, in which the three steps 12–14 of the staircase are shown in a central perspective head-on view from the eyepoint AP. Although the three riser surfaces 11.9–11.11 appear to become increasingly narrower, the image 10 appears to the observer 18 to be undistorted.

In a second realization of a method for the representation of the image 10 on the three riser surfaces 11.9–11.11, the formulas presented above are used to generate the individual partial images 10.1–10.3 via a computer.

Figure 4:
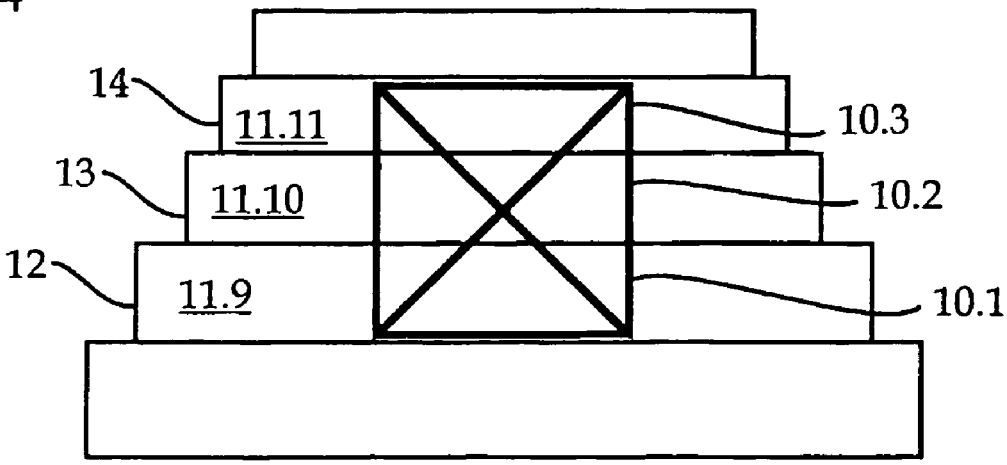
FIG. 4 is a front view of the staircase in FIG. 2 from a central perspective, as it would appear to an eye at the eyepoint.

If, in contrast to the staircase illustrated in FIGS. 2 to 4, the image 10 is not to be represented on the riser surfaces 11 but on the tread surfaces 19 of the steps, an eyepoint can be selected that lies above these tread surfaces 19 and corresponds, for example, to the position of the lens of a television camera.

Figure 5:
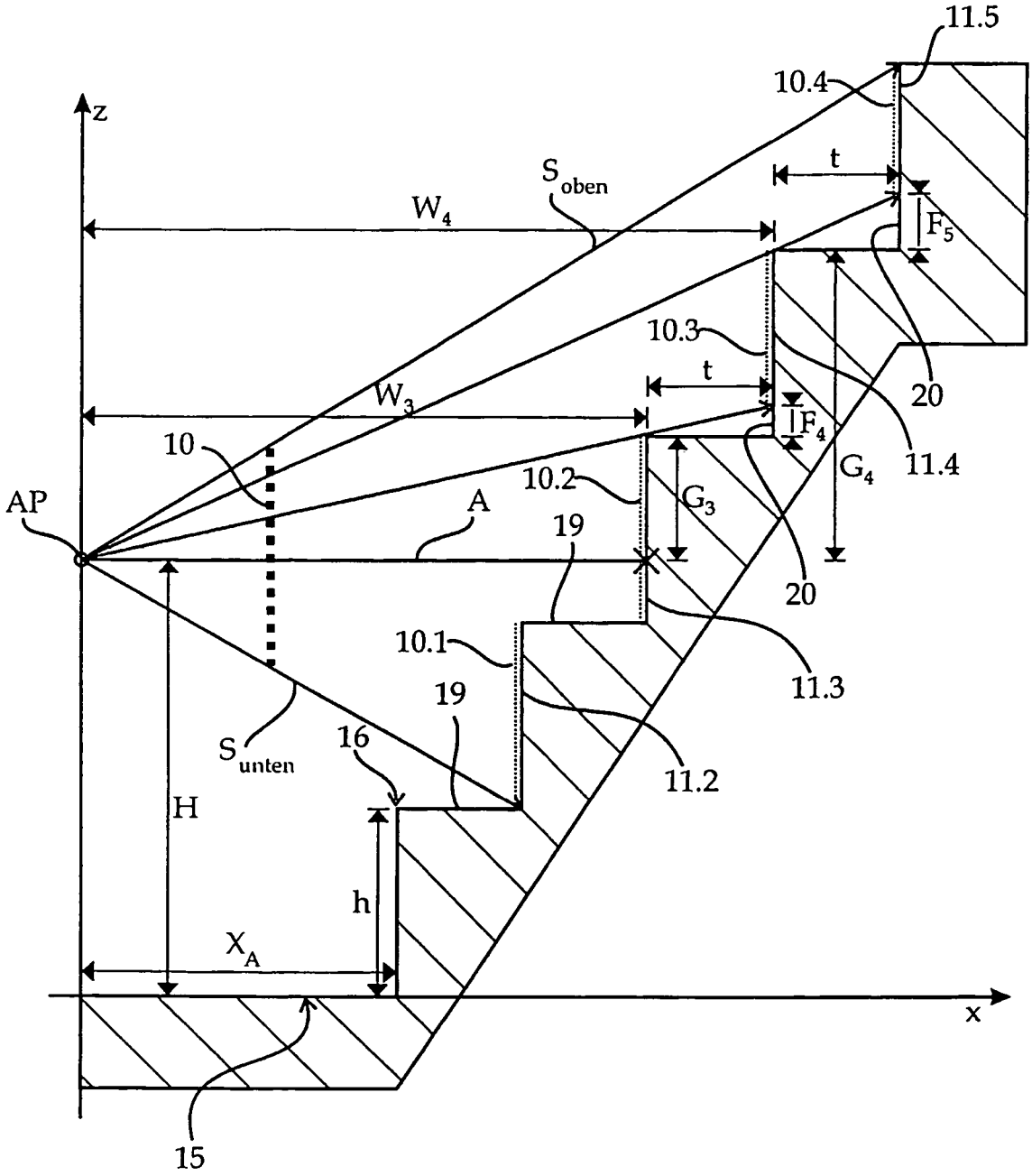
FIG. 5 is a side view of a staircase, on the steps of which an image is to be represented according to another method.
Figure 6:
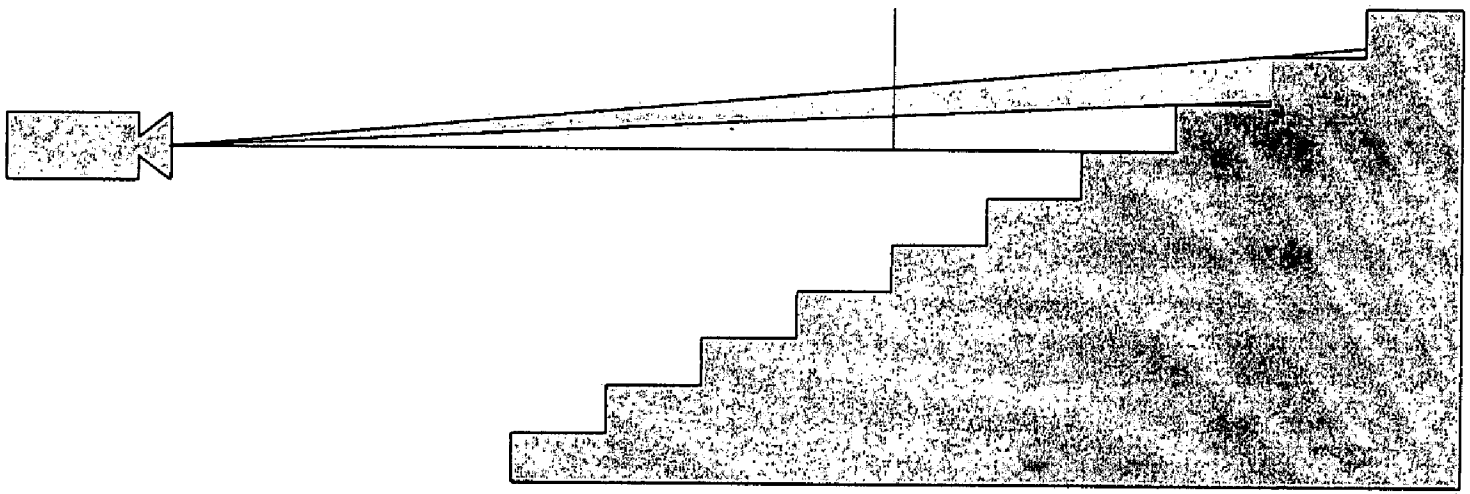
FIGS. 6 and 7 represent embodiments in which a camera is incorporated.
Figure 7:
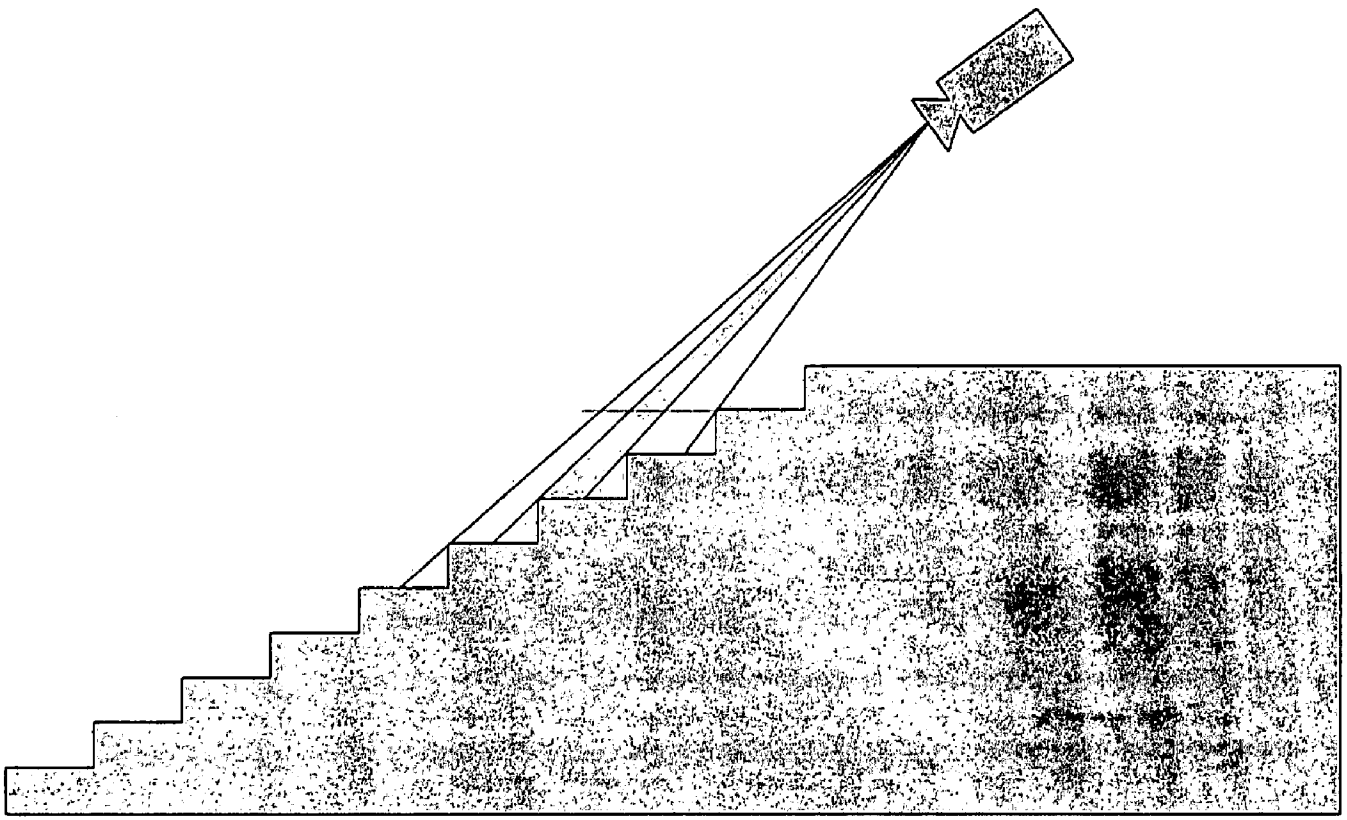

FIG. 5 shows a staircase on which the image 10 is represented on the riser surfaces 11.2, 11.3, 11.4 and 11.5 of the second to fifth steps, counting from the first, lowest step 16. The method used in this case for the representation is based on the method that was described above in connection with the staircase illustrated in FIG. 2.

The starting point for this expanded method is the awareness that on stepped surfaces a partial surface can be at least partly concealed by a partial surface lying closer to the eyepoint AP. This concealment effect, which can be termed a shadowing effect, is easy to see on the staircase in FIG. 5, for example. In that case, the stepped total surface used for the representation consists of the second to fifth riser surfaces 11.2–11.5, of which the second riser surface 11.2 lies completely below the axis of sight A, the third riser surface 11.3 lies below the axis of sight A and is intersected by it and the fourth and fifth riser surface 11.4 and 11.5 lie completely above the axis of sight A. Consequently, the total surface has at least one rear surface—namely the two riser surfaces 11.4 and 11.5—which, from the point of view of the eyepoint AP, is offset behind a forward partial surface—namely the riser surfaces 11.3 and 11.4, so that an area 20 of the rear partial surface 11.4/11.5 is concealed by the respective forward partial surface 11.3/11.4.

Because the concealed areas 20 are not visible from the eyepoint AP, the expanded method teaches that these areas are not used for the representation of the partial images 10.3, 10.4 that are assigned to the respective rear partial surfaces 11.4, 11.5.

FIG. 5 also shows clearly that the concealed areas 20 of the rear riser surfaces 11.4 and 11.5 are each bounded on their upper edge by lines of sight that intersect the upper edge of the respective next-forward riser surface 11.3 and 11.4. In this example, the staircase has steps with straight front edges, which are also simultaneously the upper edges of the riser surfaces 11, so that the concealed areas 20 are horizontal, right-angled strips on the lower edge of the rear riser surfaces 11.4, 11.5.

The formula for the calculation of the height $F_i$ of the concealed area 20 of the i-th riser surface 11.i, measured from its lower surface, is derived as described below.

For the height $F_4$ of the concealed area 20 of the fourth riser surface 11.4, the following beamset applies for the axis of sight A and the line of sight that intersects the upper edge of the next-forward, i.e. the third riser surface 11.3:

$$F_4/t=G_3/W_3$$

where:

t is the depth of the tread surface 19 of the staircase, $G_3$ is the vertical distance between the upper edge of the third riser surface 11.3 and the axis of sight A, and $W_3$ is the horizontal distance between the upper edge of the third riser surface 11.3 and the eyepoint AP.

A corresponding formula applies for the calculation of the height $F_5$ of the concealed area 20 of the fifth riser surface 11.5 of the following beamset for the axis of sight A and the line of sight that intersects the upper edge of the next-forward, i.e. the fourth riser surface 11.4:

$$F_5/t=G_4/W_4$$

where:

$G_4$ is the vertical distance between the upper edge of the fourth riser surface 11.4 and the axis of sight A, and $W_4$ is the horizontal distance between the upper edge of the fourth riser surface 11.4 and the eyepoint AP.

From these two equations, the following general formula can be derived for the height $F_i$ of the concealed area 20 of the i-th riser surface 11.i:

$$F_i=t\times G_{i-1}/W_{i-1}$$

where i is the index for the step and i=1 stands for the first, lowest step 16, $G_{i-1}$ is the vertical distance between the upper edge of the next-forward riser surface 11.(i−1) and the axis of sight A, and $W_{i-1}$ is the horizontal distance between the upper edge of the next forward riser surface 11.(i−1) and the eyepoint AP.

FIG. 5 also shows clearly that for the vertical distance $G_3$ of the third riser surface 11.3:

$$G_3+H=3\times h$$

where:

h is the height of the riser surfaces 11 of the staircase, and

H is the vertical distance between the axis of sight A and the lower landing 15; and for the horizontal distance $W_3$ of the third riser surface 11.3:

$$W_3=2\times t+X_A$$

where:

$X_A$ is the horizontal distance between the upper edge of the riser surface of the first step 16 and the eyepoint A.

Likewise, for the vertical distance $G_4$ of the fourth riser surface 11.4: $G_4+H=4\times$ and for the horizontal distance $W_4$ of the fourth riser surface 11.4: $W_4=3\times t+X_A$ From these four equations, the following general formulas can be derived for the vertical distance $G_{i-1}$ and the horizontal distance $W_{i-1}$ of the (i−1)th riser surface 11.(i−1):

$$G_{i-1}=(i-1)\times h-H$$

$$W_{i-1}=(i-2)\times t+X_A$$

With the formulas indicated above, therefore, the size of the concealed areas 20 can be calculated, which can preferably done by means of a computer. From the concealed areas 20, moreover, it is easy to calculate the size of the areas on the rear riser surfaces 11.4, 11.5 required for the representation of the partial images 10.3, 10.4, which calculation can also be preferably done by means of a computer.

It will be apparent from the foregoing that while particular forms of the invention have been illustrated and described, various modifications can be made without departing from the spirit and scope of the invention. Accordingly, it is not intended that the invention be limited, except as by the appended claims.

What is claimed is:

1. A method for the representation of an image on a stepped surface with at least two partial surfaces which run at right angles to an axis of sight (A) and are offset relative to each other along the axis of sight (A), said method comprising:

selecting an eyepoint (AP) which lies on the axis of sight (A) in front of the partial surfaces;

dividing the image into partial images which are assigned to the partial surfaces by being projected from the eyepoint (AP) onto the partial surfaces; and representing each partial image on the partial surface to which it is assigned.

2. A method for the representation of an image on a stepped surface with at least two partial surfaces which run at a right angle to an axis of sight (A) and are offset relative to each other along the axis of sight (A); said method comprising:

selecting an eyepoint (AP) which lies on the axis of sight (A) in front of the partial surfaces;

dividing the image into partial images which are assigned to the partial surfaces so that a first partial image is assigned to a first step lying closest to the eyepoint (AP);

modifying the first partial image according to a maximum space available;

enlarging each additional partial image relative to the first partial image corresponding to the distance of its assigned partial surface from the eyepoint (A); and representing each partial image on the partial surface to which it is assigned.

3. The method of claim 2, wherein each said partial image has an enlargement factor and the enlargement factor of a partial image relative to the first partial image is equal to the quotient of the distance of its corresponding partial surface from the eyepoint (AP) and the distance of the first partial surface from the eyepoint (AP).

4. The method of claim 1 or 2, wherein the stepped surface is formed by a surface of a staircase.

5. The method of claim 4, wherein the staircase lies in a grandstand of a sports stadium or an exhibition or performance venue.

6. The method of claim 4, wherein the partial surfaces are formed by riser surfaces of steps.

7. The method of claim 4, wherein the partial surfaces are formed by tread surfaces of the steps.

8. The method of claim 1 or 2, wherein the eyepoint (AP) is defined by a position of a camera.

9. The method of claim 1 or 2, wherein the stepped surface has at least one rear partial surface which, from the point of view of the eyepoint (AP) is offset behind a forward partial surface so that an area of the rear partial surface is concealed by the forward partial surface and that this concealed area of the rear partial surface is not used for the representation of the partial image assigned to the rear partial surface.

10. The method of claim 9, wherein:

the surface on which the image will be displayed is formed by the surface of a staircase;

the axis of sight (A) runs horizontally;

the partial surfaces are formed by riser surfaces of the steps, at least one riser surface of which, from the point of view of the eyepoint (AP), lies behind the riser surface on which the axis of sight (A) alights, and thus has on its lower edge a strip-shaped area which is concealed by the next-forward riser surface; and the height (Fi) of the concealed area measured from a lower edge of the rear riser surface is determined by the following formula:

$$Fi=t\times Gi-1/Wi-1$$

where:i is the index for the step and i=1 is the index for the first, lowest step, t is the depth of the tread surface of the staircase, Gi−1 is the vertical distance between the upper edge of the next-forward riser surface and the axis of sight (A), and Wi−1 is the horizontal distance between the upper edge of the next-forward riser surface and the eyepoint (AP).

11. The method of claim 10, wherein:

the vertical distance (Gi−1) is determined by the following formula:

$$Gi-1=(i-1)\times h-H$$

where:h is the height of the riser surfaces (11) of the staircase, and

H is the vertical distance between the axis of sight (A) and a first step of the staircase; and the horizontal distance Wi−1 is determined by the following formula:

$$Wi-1=(i-2)\times t+XA$$

where XA is the horizontal distance between the upper edge of a riser surface of a first step and an eyepoint (AP).

12. A staircase with at least two riser surfaces on which an image is represented, one of the surfaces being a lowest riser surface, characterized by the fact that:

the image is divided into partial images which are assigned to the riser surfaces and which are represented on the riser surfaces to which they are assigned; and each partial image is enlarged relative to the partial image that is lowest on the staircase, corresponding to the horizontal distance of a riser surface to which it is assigned from the lowest riser surface.

13. The staircase of claim 12, wherein an enlargement factor of each partial image is equal to the quotient of the sum of the horizontal distance of the riser surface to which it is assigned from the lowest riser surface and the horizontal distance of the lowest riser surface from a specified eyepoint (AP) lying in front of the staircase and the horizontal distance of the lowest riser surface from the eyepoint (AP).

14. The staircase of claim 13, wherein the eyepoint (AP) is defined by a position of a camera.

15. The staircase of claim 13, wherein it has at least one rear partial surface which, from the point of view of the eyepoint (AP) is offset behind a forward partial surface so that an area of the rear partial surface is concealed by the forward partial surface and that this concealed area of the rear partial surface is not used for the representation of the partial image assigned to the rear partial surface.

16. The staircase of claim 15, wherein:

the axis of sight (A) runs horizontally;

of the riser surfaces, at least one riser surface from the point of view of the eyepoint (AP), lies behind the riser surface on which the axis of sight (A) alights, and thus on its lower edge has a strip-shaped area which is concealed by the next forward riser surface; and the height (Fi) of the concealed area measured from the lower edge of the rear riser surface is determined by the following formula:

$$Fi=t\times Gi-1/W\,i-1$$

where: i is the index for the step and i=1 is the index for the first, lowest step, t is the depth of the tread surface of the staircase, Gi−1 is the vertical distance between the upper edge of the next-forward riser surface and the axis of sight (A), and Wi−1 is the horizontal distance between the upper edge of the next-forward riser surface and the eyepoint (AP).

17. The staircase of claim 16, wherein:

the vertical distance (G i−1) is determined by the following formula:

$$Gi-1=(i-1)\times h-H$$

where:h is the height of the riser surfaces of the staircase, and

H is the vertical distance between the axis of sight (A) and the lower landing; and the horizontal distance (Wi−1) is determined by the following formula:

$$Wi-1=(i-2)\times t+XA$$

where XA is the horizontal distance between the upper edge of the riser surface of the first step and the eyepoint (AP).

18. The staircase of claim 12, wherein the staircase is an escalator.

19. The staircase of claim 12, wherein the staircase lies in a grandstand of a sports stadium or a performance or exhibition venue.

20. A staircase with at least two tread surfaces on which an image is represented, characterized by the fact that:

the image is divided into partial images that are assigned to the tread surfaces and are represented on the tread surfaces to which they are assigned; and each partial image is enlarged with respect to a preceding partial image as a function of the vertical distance of the tread surface to which it is assigned from the uppermost tread surface.

21. The staircase of claim 20, wherein the enlargement factor of a partial image to its preceeding partial image is equal to the quotient of the sum of the vertical distance of the tread surface to which it is assigned from the topmost tread surface and the vertical distance of a topmost tread surface from a specified eyepoint (AP) that lies above the staircase and the vertical distance of the uppermost tread surface from the eyepoint (AP).

22. The staircase of claim 21, wherein the eyepoint (AP) is defined by a position of a camera.

23. The staircase of one of claim 21, wherein it has at least one rear partial surface which, from the point of view of the eyepoint (AP) is offset behind a forward partial surface so that an area of the rear partial surface is concealed by the forward partial surface and that this concealed area of the rear partial surface is not used for the representation of the partial image assigned to the rear partial surface.

24. The staircase of one of claim 20, wherein the staircase is an escalator.

25. The staircase of one of claim 20, wherein the staircase lies in a grandstand of a sports stadium or a performance or exhibition venue.

* * * * *